US010282946B2

(12) United States Patent
Brown et al.

(10) Patent No.: US 10,282,946 B2
(45) Date of Patent: May 7, 2019

(54) LUCKY SPOT BETTING

(71) Applicant: IGT, Las Vegas, NV (US)

(72) Inventors: Bradford D. Brown, Sparks, NV (US); Robert W. Ruymann, Reno, NV (US)

(73) Assignee: IGT, Las Vegas, NV (US)

( * ) Notice: Subject to any disclaimer, the term of this patent is extended or adjusted under 35 U.S.C. 154(b) by 700 days.

(21) Appl. No.: 14/515,913

(22) Filed: Oct. 16, 2014

(65) Prior Publication Data

US 2016/0110964 A1 Apr. 21, 2016

(51) Int. Cl.

| | |
|---|---|
| ***G07F 17/32*** | (2006.01) |
| ***G07F 17/00*** | (2006.01) |
| ***G07F 19/00*** | (2006.01) |

(52) U.S. Cl.

CPC ..... *G07F 17/3288* (2013.01); *G07F 17/32* (2013.01)

(58) Field of Classification Search

CPC .... G07F 17/3288; G07F 17/32; G07F 17/329; G07F 17/3293; A63F 3/0645; A63F 3/0605; A63F 9/00; A63F 1/00; A63F 2001/005; A63F 3/00157; A63F 3/062

See application file for complete search history.

(56) References Cited

U.S. PATENT DOCUMENTS 4,033,588 A 7/1977 Watts et al.
4,611,811 A 9/1986 Haase et al.
4,661,906 A 4/1987 Difrancesco et al.
4,711,454 A 12/1987 Small
4,747,600 A 5/1988 Richardson et al.
4,775,155 A 10/1988 Lees
4,798,387 A 1/1989 Richardson
4,875,686 A 10/1989 Timms
5,005,840 A 4/1991 Schwartz et al.
5,043,887 A 8/1991 Richardson et al.
5,046,737 A 9/1991 Feinberg
5,072,381 A 12/1991 Richardson et al.
5,100,139 A 3/1992 Di Bella
5,116,049 A 5/1992 Sludikoff et al.
5,158,293 A 10/1992 Mullins
5,280,909 A 1/1994 Tracy et al.
5,351,970 A 10/1994 Fioretti et al.
5,364,104 A 11/1994 Jones et al.
5,377,973 A 1/1995 Jones et al.
5,401,024 A * 3/1995 Simunek ..... G07F 17/3244 273/269
5,419,592 A 5/1995 Stuart
5,482,289 A 1/1996 Weingardt et al.
5,569,083 A 10/1996 Fioretti et al.
5,586,937 A 12/1996 Menashe
5,639,089 A 6/1997 Matsumoto et al.
5,647,798 A 7/1997 Falciglia
5,651,735 A 7/1997 Baba
5,679,077 A 10/1997 Pocock et al.
5,687,971 A 11/1997 Khaladkar
(Continued)

*Primary Examiner* — Milap Shah
(74) *Attorney, Agent, or Firm* — Neal, Gerber & Eisenberg LLP

(57) ABSTRACT

Methods and systems are provided for enabling player to play a keno game allowing for additional betting. The player may select keno board spots on the keno board, and then place an additional wager on one of the selected keno board spots. If the selected keno board spot is part of a winning combination, the player may be awarded a supplemental bonus.

17 Claims, 6 Drawing Sheets

(56) References Cited

U.S. PATENT DOCUMENTS 5,718,631 A 2/1998 Invencion et al.
5,727,786 A 3/1998 Weingardt et al.
5,743,526 A 4/1998 Inoue
5,755,619 A 5/1998 Matsumoto et al.
5,766,076 A 6/1998 Pease et al.
5,779,545 A 7/1998 Berg et al.
5,823,534 A 10/1998 Banyai et al.
5,833,537 A 11/1998 Barrie
5,855,515 A 1/1999 Pease et al.
5,857,911 A 1/1999 Fioretti et al.
5,871,398 A 2/1999 Schneier et al.
5,885,158 A 3/1999 Torango et al.
5,909,875 A 6/1999 Weingardt et al.
5,935,001 A 8/1999 Baba et al.
5,935,002 A 8/1999 Falciglia
5,945,655 A 8/1999 Gilgeous et al.
5,947,820 A 9/1999 Morro et al.
6,017,032 A 1/2000 Grippo et al.
6,024,640 A 2/2000 Walker et al.
6,079,711 A 6/2000 Wei et al.
6,099,407 A 8/2000 Parker et al.
6,102,400 A * 8/2000 Scott ..... A63F 3/00157 273/138.1
6,146,272 A 11/2000 Walker et al.
6,146,273 A 11/2000 Olsen et al.
6,168,521 B1 1/2001 Luciano et al.
6,183,361 B1 2/2001 Cummings et al.
6,210,275 B1 4/2001 Olsen
6,210,276 B1 4/2001 Mullins
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,315,290 B1 * 11/2001 Roethel ..... A63F 3/0645 273/138.1
6,315,291 B1 11/2001 Moody
6,325,716 B1 12/2001 Walker et al.
6,358,151 B1 3/2002 Enzminger et al.
6,364,313 B1 * 4/2002 Moody ..... A63F 3/065 273/138.1
6,368,213 B1 4/2002 McNabola
6,368,214 B1 4/2002 Luciano
6,398,644 B1 6/2002 Perrie et al.
6,398,646 B1 6/2002 Wei et al.
6,402,614 B1 6/2002 Schneier et al.
6,425,823 B1 7/2002 Byrne
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,599,193 B2 7/2003 Baerlocher et al.
6,607,440 B2 8/2003 Santini, Jr.
6,609,973 B1 8/2003 Weiss
6,645,072 B1 11/2003 Kellen
6,656,044 B1 12/2003 Lewis
6,656,045 B2 12/2003 Wei et al.
6,722,655 B1 4/2004 Camero
6,726,563 B1 4/2004 Baerlocher et al.
6,755,738 B2 6/2004 Glasson et al.
6,755,739 B2 6/2004 Santini, Jr.
6,758,747 B2 7/2004 Baerlocher
6,780,108 B1 8/2004 Luciano, Jr. et al.
6,796,899 B2 9/2004 Baerlocher
6,802,776 B2 10/2004 Lind et al.
6,824,465 B2 11/2004 Luciano, Jr.
6,832,956 B1 12/2004 Boyd et al.
6,840,858 B2 1/2005 Adams
6,966,836 B1 * 11/2005 Rush ..... G07F 17/32 463/25
7,258,608 B2 8/2007 Khal
7,297,059 B2 11/2007 Vancura et al.
7,303,469 B2 12/2007 Kaminkow
7,306,519 B2 12/2007 Baerlocher
7,357,716 B2 4/2008 Marks et al.
7,399,227 B2 7/2008 Michaelson et al.
7,470,184 B2 12/2008 Baerlocher et al.
7,544,129 B2 6/2009 Baerlocher
7,597,621 B2 10/2009 Baerlocher
7,651,392 B2 1/2010 Pennington et al.
7,666,093 B2 2/2010 Lafky et al.
7,674,180 B2 3/2010 Graham et al.
7,682,241 B2 3/2010 Baerlocher
7,682,248 B2 3/2010 Baerlocher et al.
7,704,141 B1 * 4/2010 Marks ..... G07F 17/34 463/16
7,780,520 B2 8/2010 Baerlocher
7,824,257 B2 11/2010 Jubinville et al.
7,837,547 B2 * 11/2010 Cannon ..... G07F 17/32 463/16
7,841,939 B2 11/2010 Baerlocher et al.
7,862,430 B2 1/2011 Baerlocher et al.
7,901,282 B2 3/2011 Cannon
7,914,377 B2 3/2011 Benbrahim et al.
7,942,737 B2 5/2011 Cregan et al.
7,963,845 B2 6/2011 Baerlocher
7,985,133 B2 7/2011 Baerlocher et al.
8,002,620 B2 8/2011 Nicely et al.
8,025,561 B2 9/2011 Reddicks et al.
8,033,903 B2 10/2011 Cregan
8,070,597 B2 12/2011 Cuddy
8,092,302 B2 1/2012 Cuddy et al.
8,096,874 B2 1/2012 Nicely et al.
8,113,939 B2 2/2012 Cannon
8,123,604 B2 2/2012 Lancaster et al.
8,128,491 B2 3/2012 Vasquez et al.
8,152,630 B2 4/2012 Cohen
8,157,646 B2 4/2012 Pawloski et al.
8,172,660 B2 5/2012 Lancaster et al.
8,197,337 B2 6/2012 DeWaal et al.
8,210,937 B2 7/2012 Cregan et al.
8,231,453 B2 7/2012 Wolf et al.
8,376,836 B2 2/2013 Baerlocher et al.
8,382,572 B2 2/2013 Hoffman et al.
8,425,303 B2 4/2013 Kennedy et al.
8,500,548 B2 8/2013 Baerlocher et al.
8,740,687 B1 * 6/2014 Brown ..... G07F 17/326 463/16
8,814,651 B1 * 8/2014 Humphrey ..... G07F 17/326 463/17
2002/0045472 A1 4/2002 Adams
2002/0052231 A1 5/2002 Fioretti
2002/0094859 A1 7/2002 Hirsch et al.
2002/0098883 A1 7/2002 Packes, Jr. et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2003/0017867 A1 1/2003 deKeller
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.

(56) References Cited

U.S. PATENT DOCUMENTS

2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0037832 A1* 2/2005 Cannon ..... G07F 17/32 463/18
2005/0054404 A1 3/2005 Baerlocher
2005/0054415 A1 3/2005 Kaminkow et al.
2005/0059449 A1 3/2005 Yarbrough
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064932 A1 3/2005 Cannon
2005/0075161 A1 4/2005 McGlone et al.
2005/0096119 A1 5/2005 Lind et al.
2005/0096123 A1 5/2005 Cregan et al.
2005/0101370 A1 5/2005 Lind et al.
2005/0101387 A1 5/2005 Wolf
2005/0119042 A1 6/2005 Chamberlain et al.
2005/0130730 A1 6/2005 Lind et al.
2005/0148382 A1 7/2005 Fox
2005/0151317 A1* 7/2005 Zajac ..... A63F 3/00157 273/146
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0187014 A1 8/2005 Saffari et al.
2005/0227753 A1 10/2005 Luciano
2005/0255906 A1 11/2005 Lind et al.
2006/0084490 A1 4/2006 Khal
2006/0128457 A1* 6/2006 Cannon ..... G07F 17/32 463/16
2006/0189375 A1 8/2006 Dodge
2007/0021185 A1 1/2007 Walker et al.
2007/0052172 A1 3/2007 Dargue
2007/0117611 A1 5/2007 Dodge
2007/0149277 A1* 6/2007 Ghaly ..... G07F 17/3262 463/20
2007/0173312 A1* 7/2007 Dodge ..... G07F 17/32 463/18
2007/0281774 A1* 12/2007 Khal ..... G07F 17/3244 463/19
2008/0026813 A1* 1/2008 Cannon ..... G07F 17/3202 463/18
2008/0076542 A1 3/2008 Iddings et al.
2008/0090651 A1 4/2008 Baerlocher
2008/0102921 A1* 5/2008 Urquhart ..... G07F 17/34 463/20
2008/0102952 A1 5/2008 Walker et al.
2008/0108430 A1 5/2008 Evans
2008/0108431 A1 5/2008 Cuddy et al.
2008/0254894 A1 10/2008 Michaelson et al.
2009/0042645 A1 2/2009 Graham et al.
2009/0075715 A1 3/2009 Coleman et al.
2009/0124362 A1 5/2009 Cuddy et al.
2009/0124364 A1 5/2009 Cuddy et al.
2009/0197664 A1 8/2009 Schultz
2010/0081497 A1 4/2010 Wolf et al.
2010/0120489 A1 5/2010 Meyer
2011/0003627 A1 1/2011 Nicely et al.
2011/0003637 A1 1/2011 LeFever
2011/0028201 A1 2/2011 Warner et al.
2011/0111843 A1 5/2011 Nicely et al.
2012/0129588 A1* 5/2012 Cannon ..... G07F 17/3244 463/20
2012/0252550 A1* 10/2012 Seaton ..... G07F 17/3286 463/18
2012/0322529 A1* 12/2012 Gilbertson ..... G07F 17/3267 463/17
2013/0079123 A1 3/2013 Nicely et al.
2013/0273995 A1* 10/2013 Seaton ..... G07F 17/3286 463/18
2014/0018146 A1 1/2014 Zielinski et al.
2014/0228089 A1* 8/2014 Seaton ..... G07F 17/3267 463/18
2015/0065222 A1* 3/2015 Lovaas ..... G07F 17/3286 463/18
2015/0087379 A1* 3/2015 Naylor ..... G07F 17/3286 463/18
2015/0087380 A1* 3/2015 Brown ..... G07F 17/3286 463/18
2015/0087381 A1* 3/2015 Larson ..... G07F 17/3288 463/18
2015/0248807 A1* 9/2015 Berman ..... G07F 17/3293 463/11
2015/0254923 A1* 9/2015 Wenker ..... G07F 17/329 463/18

* cited by examiner

LUCKY SPOT BETTING

BACKGROUND

The present disclosure relates generally to wager-based games and more particularly to keno games. A keno game displays to a player a keno board. A player wagers by marking spots on the keno board, after which the keno game randomly selects drawn spots. Player payout is determined based on matches between the drawn spots and the player-selected spots.

SUMMARY

According to an example embodiment, a method for providing a keno game for play is provided. The method includes receiving a plurality of player selected keno board spots. The method further includes receiving an additional wager amount for an award enhancement spot. The method further includes determining, using the processor, a plurality of draws. The method further includes determining, using the processor, a plurality of matches between the plurality of draws and the plurality of player selected keno board spots, wherein the award enhancement spot matches a draw from the plurality of draws. The method further includes determining a player award based on the determined plurality of matches and the additional wager amount.

According to another example embodiment, an electronic device for playing a keno game is provided. The electronic device comprises a display configured to display the keno game to a player having a keno board showing a plurality of spots, a user-input panel, and a game controller. The game controller has one or more data processors and one or more storage devices storing instructions that, when executed by the one or more data processors, cause the one or more data processors to perform operations. The operations further comprising receiving a plurality of player selected keno board spots. The operations further comprising receiving an additional wager amount for an award enhancement spot. The operations further comprising determining, using the processor, a plurality of draws. The operations further comprising determining, using the processor, a plurality of matches between the plurality of draws and the plurality of player selected keno board spots, wherein the award enhancement spot matches a draw from the plurality of draws. The operations further comprising determining a player award based on the determined plurality of matches and the additional wager amount.

According to another example embodiment, a computer-readable storage medium having machine instructions stored therein is provided. The instructions being executable by a processor to cause the processor to perform operations. The operations comprising receiving a selection of a plurality of player spots. The operations further comprising displaying a keno board showing a plurality of keno board spots. The operations further comprising receiving a plurality of player selected keno board spots. The operations further comprising receiving an additional wager amount for an award enhancement spot. The operations further comprising determining, using the processor, a plurality of draws. The operations further comprising determining, using the processor, a plurality of matches between the plurality of draws and the plurality of player selected keno board spots, wherein the award enhancement spot matches a draw from the plurality of draws. The operations further comprising determining a player award based on the determined plurality of matches and the additional wager amount.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

According to various embodiments disclosed herein, a keno game with additional betting features is provided. A player starts the keno game by selecting spots on a keno board. The player may select and place an additional bet on one of the already selected spots (sometimes referred to as an "award enhancement spot" or "lucky" spot herein), thereby increasing their wager. In some embodiments, the first spot (or the last spot) marked by the player is the "lucky" spot. In these embodiments, the player may change the "lucky" spot to another selected spot (e.g., by pressing that spot and the two spots would toggle). The keno game may have an onscreen location dedicated to displaying the "lucky" spot.

Next, draws are selected and marked on the keno board. If the player selected "lucky" spot matches a selected draw (i.e., the player selected spot is a "hit"), then the player may be awarded a payout enhancement, e.g., additional hit(s), a multiplier equal to the amount of the bet on the "lucky" spot, a number of free games, extra balls, and/or other enhancements. Thus, the additional betting may serve as a multiplier in case the selected "lucky" spot is a "hit".

For example, the player may select spots numbered 1, 5, 11, 27, 45, and 68, and then bet three additional credits on the spot numbered 5. In this example, if the spot numbered 5 is a "hit", then the player's total payout would be enhanced. For example, the payout may be multiplied by three (i.e., by the additional bet amount). If the player's payout amount is twenty credits, then the total payout amount would be increased to sixty credits because the twenty credits would be multiplied by three. Other payout enhancements may also be used.

In another embodiment, the player may select a spot to act as a free game trigger. In this embodiment, if that spot is "hit" as part of a winning combination, then the player is awarded a number of free games based upon how many credits they placed on that spot. For example, if the player wagered three points on the "lucky" spot, then if that spot is "hit" by a draw, then the player may be awarded a number (e.g., three) free games. In another embodiment, the number of spots that the player selects may be taken into account when determining the number of free games to award to the player or the total payout amount.

Figure 1A:
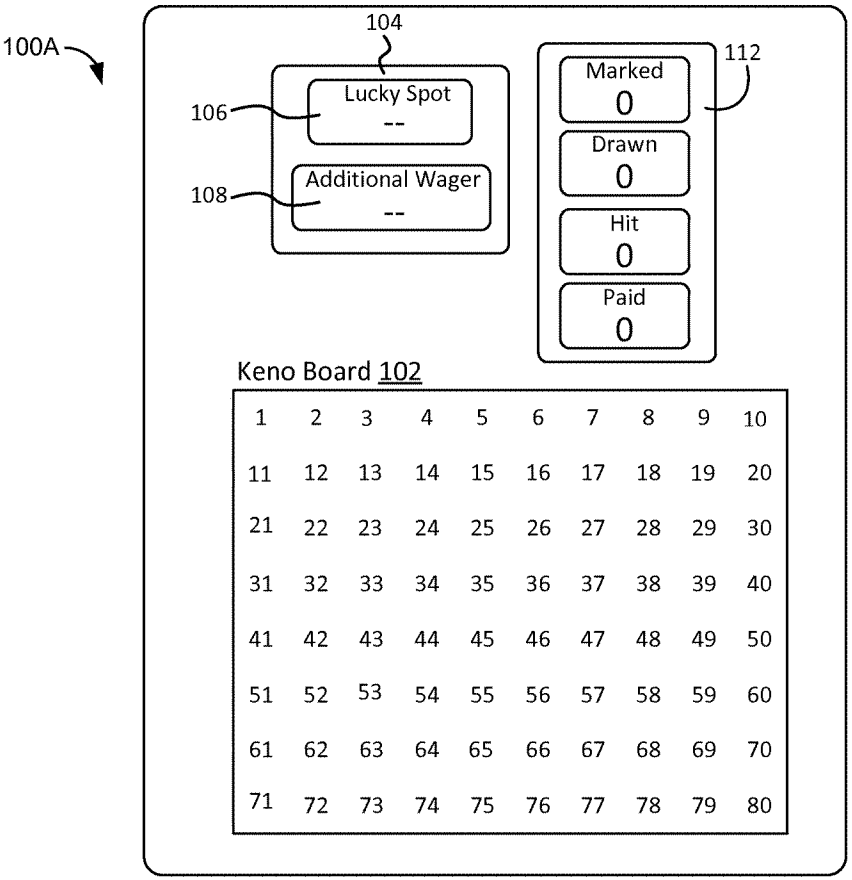
FIGS. 1A-C are user interfaces of a keno game illustrating additional wagering features, in accordance with an example implementation.
Figure 1B:
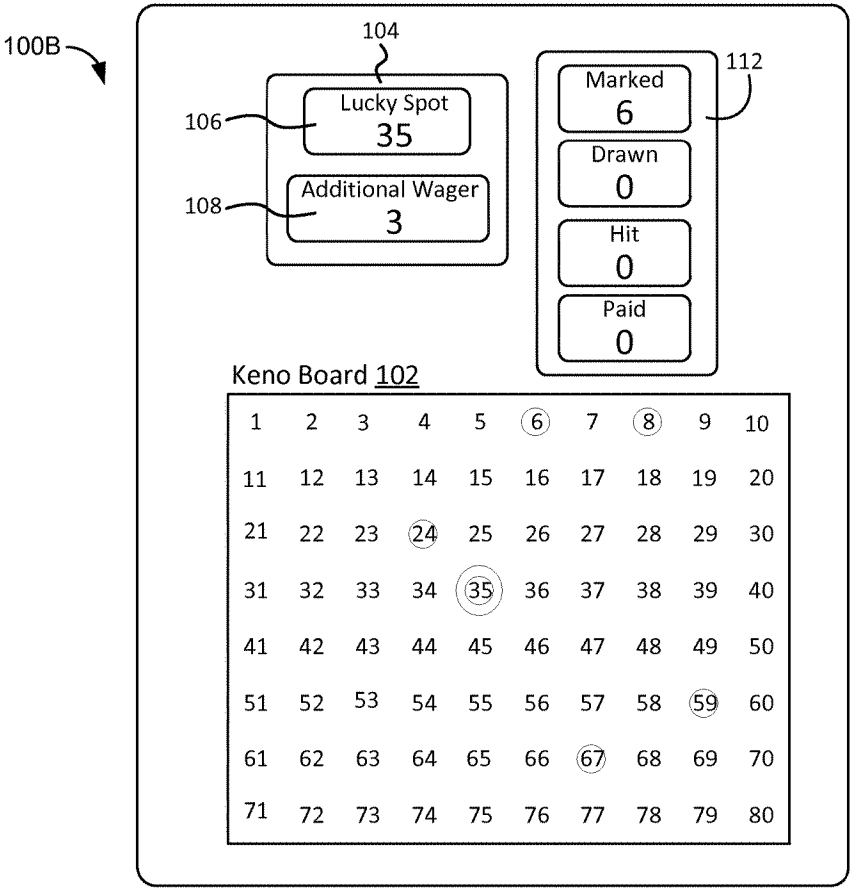
Figure 1C:
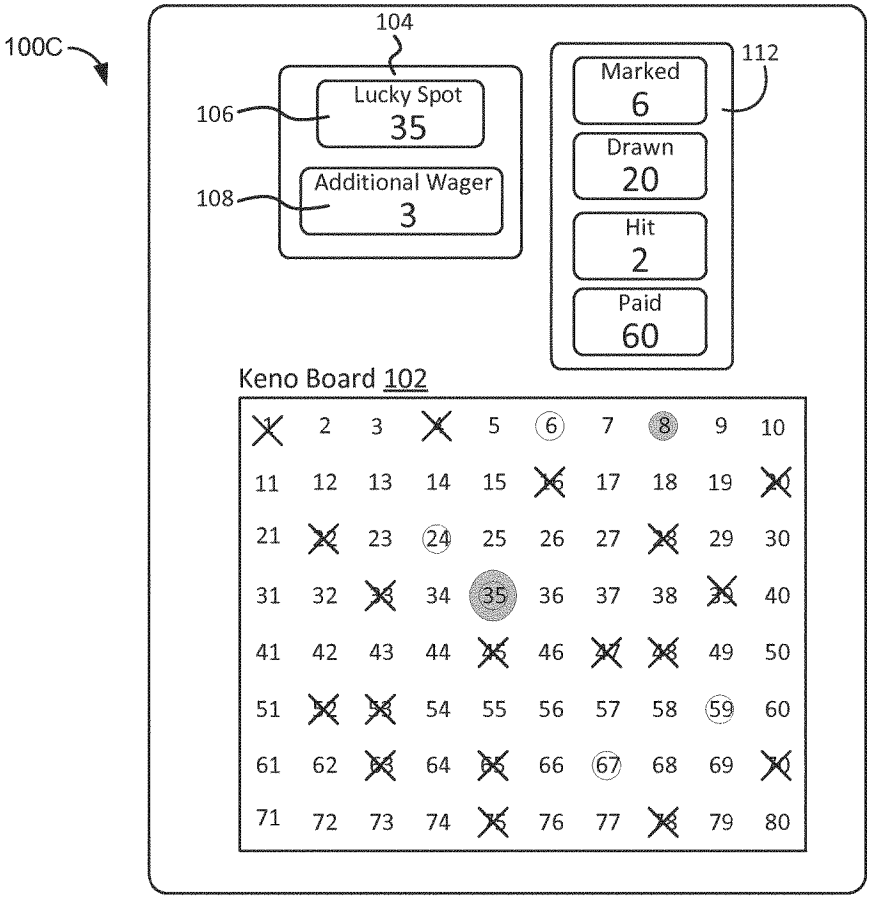

FIGS. 1A-C illustrate a keno game during which a player places an additional wager on a selected spot. FIG. 1A illustrates a keno game user interface 100 at the beginning of a keno game session, before the player makes any selections on the keno board. The keno game user interface 100 includes a keno board 102 with eighty keno board spots numbered between one and eighty. The keno board 102 does not show any player spot selections or draws. A section 104 provides information related to the player's lucky spot selection. In particular, an area 106 in the section 104 displays the keno board spot number that the player bet additional credits on. An area 108 in the section 104 provides the additional wager that the player placed on the spot identified in the area 106. For example, the area 108 may show the additional number of credits wagered by the player on the spot identified in the area 106.

The keno game user interface 100 further displays a section 112, which provides summary information about the keno board game session. As shown, the section 112 provides a number of player marked spots, a number of spots drawn by the keno game, a number of identified hits between the player marked spots and the draws, and an amount paid based on the number of hits. The information provided in the sections 104 and 112 may be displayed in any other manner to the player. For example, this information may be shown together in a single section in a different order. In another example, at least some of this information may be hidden, and the player may request to view this information (e.g., by clicking on a button or another item on the keno board user interface 100).

In FIG. 1B, the keno board 102 and the sections 104 and 112 reflect the player keno board spot selections. As shown by circles around player selected keno board spots, the player selected spots numbered 6, 8, 24, 35, 59, and 67. Although the player selections on the keno board 102 are shown using a single circle drawn around the selected spot, any other visualizations (e.g., any combination of shapes, animations, colors, etc.) may be utilized to identify the player selected spots. The section 112 displays that a total of six spots were marked (i.e., selected on the keno board) by the player, and that no spots were drawn yet. The section 112 further displays that no hits were identified and nothing was yet paid to the player.

After selecting the six spots (i.e., spots numbered 6, 8, 24, 35, 59, and 67), the player may place an additional wager on one of these selected spots. For example, in the illustrated example, after the player selects the spot numbered 35 as one of the player selected spots, the player may select the spot on the keno board again to indicate that he wishes to place an additional bet on this spot. In another embodiment, the player requests placing the additional bet on a spot using another component of the keno board user interface 100B. For example, the player may type in the spot number in the area 106. In another example, the player may click on a button (not shown) or another visual indicator provided in the user interface, which would in turn allow the player to identify the "lucky" spot and place an additional wager on that "lucky" spot. In some embodiments, the player does not place an additional wager and one of the spots (e.g., the first player marked spots) is considered the "lucky" spot. For example, the first spot selected by the player is the lucky spot, and if that spot is hit, it will increase the win amount awarded to the player.

In some embodiments, the player may select keno board spots by clicking on them on the keno board. In other embodiments, the player may enter their spot selections using a keyboard or another input device (e.g., enter the numbers associated with the spots). In other embodiments, player selected spots may be selected by the keno game. For example, the player may select a button that triggers automatic selections of keno board spots for the player. In these embodiments, the keno game may randomly select numbers (e.g., without replacement) from a set of available numbers (e.g., numbers from one through eighty), and mark corresponding spots on the keno board. As shown, the marked spots including spots that are not the "lucky" spot are displayed on the screen while the player is selecting spots on the keno board.

In the illustrated example, in which the player places an additional wager of three points on the spot numbered 35, two circles around the spot numbered 35 indicate that the player placed an additional wager on the spot numbered 35. The spot numbered 35 is referred to as the "lucky" spot in this keno game session. Any other name or label may be used to refer to this spot. The area 104 indicates that the player bet three credits on the spot numbered 35. Although the additional betting on the "lucky" spot is shown using a larger circle drawn around the circle indicating that the player selected the spot numbered 35, other visualizations (e.g., objects in any shape, color, animations, symbols, etc.) may be utilized to indicate that the player selected a spot to place additional bet on.

FIG. 1C illustrates the keno board user interface 100 after twenty draws are selected by the keno game and displayed on the keno board 102. The draws may be randomly selected from the available eighty numbers, with or without replacement. As shown on the keno board 102, spots numbered 1, 4, 8, 16, 20, 22, 28, 33, 35, 39, 45, 47, 48, 52, 53, 63, 65, 70, 75, and 78 are selected as draws. Although the draws are displayed on the keno board using "X" symbols, any other symbol, color, animation, shape, or any combination thereof may be utilized. The section 112 is updated to indicate that twenty draws are selected. Another section (not shown) of the keno game user interface 100 may list the drawn spot numbers (e.g., spot numbers 1, 4, 8, etc.). Although the player marked spots are indicated on the keno board, the player selected spots that are not the "lucky" spot may be not displayed on the keno board during or after drawing. For example, after all the spots are marked by the player, the spots that are not the "lucky" spot may be erased from the keno board.

The two spots that are identified as "hits" (i.e., spots numbered 8 and 35) are emphasized on the keno board by coloring the circles around those spots in grey color. However, any other visualization may be utilized to emphasize to the player that these two spots are "hits". For example, blinking stars may be drawn around the "hits" on the keno board. The "lucky" spot numbered 35 is a "hit" and is emphasized in the same manner as the "hit" spot numbered "8". In another implementation, when the "lucky" spot matches a selected draw, it may be visually emphasized in a manner different from the other "hits". For example, a blinking triangle may be drawn around the hit "lucky" spot, while color of the other spots that are "hits" may be changed.

As indicated in the section 112, two "hits" (i.e., spots numbered 8 and 35) are detected on the keno board. The section 112, the section 104, or another section in the keno game user interface 100 may indicate that the "lucky" spot (i.e., the spot numbered 35) matched a draw. In some embodiments, if all the player marked spots are "hit" by draws, then there may be no special bonus awarded for hitting the "lucky" spot.

Although not shown, the keno game user interface 100 may display one or more paytables. The paytables may identify win amounts for different possible numbers of detected hits between player selected spots and draws. For example, a paytable may include the number of points that the player may be awarded for the number of "hits" detected. For example, a paytable may indicate that a player is entitled to twenty points when three hits are detected.

The amount paid shown in the section 112 may take into account that the "lucky" spot was "hit" by a draw. In the example above, where two "hits" justify payment of twenty points to the player (according to the paytable), the award due to the player may be twenty points multiplied by the additional wager placed by the player on the "lucky" spot. Thus, the player is entitled to a total of sixty points (i.e., twenty points multiplied by a multiplier having a value of three).

In another embodiment, the additional wager placed by the player on the "lucky" spot may be used for awarding the player free games. A player may wager for a certain number of free games (e.g., three games) by placing an additional wager on a "lucky" spot. In one implementation, the additional wager may be equivalent to the number of free games that would be awarded if the "lucky" spot is "hit" by a draw. For example, by wagering three points on the "lucky" spot, the player will be awarded three free games if the "lucky" spot matches one of the draws. Other payout enhancements may also be used.

In another implementation, the player may have to wager a predetermined number of points on the "lucky" spot to qualify for a particular number of free games. For example, a table or another visualization may indicate to the player that wagering twenty points on a "lucky" spot would qualify the player for three free games if that "lucky" spot is a "hit". The player may select the number of additional points they wish to place on the "lucky" spot. The section 104 or another section may indicate to the player the number of free games that the player would be entitled to if the "lucky" spot is part of a winning combination.

The keno game user interface 100 may be displayed to a player on a monitor of a gaming machine (e.g., at a casino) or on any computing device such as a mobile phone, tablet, personal computer, etc. Although the keno board spots are shown as numbers, the keno board spots may be shown using any shapes (e.g., circles, stars). For example, circles may be drawn around numbers to signify keno board spots.

Figure 2:
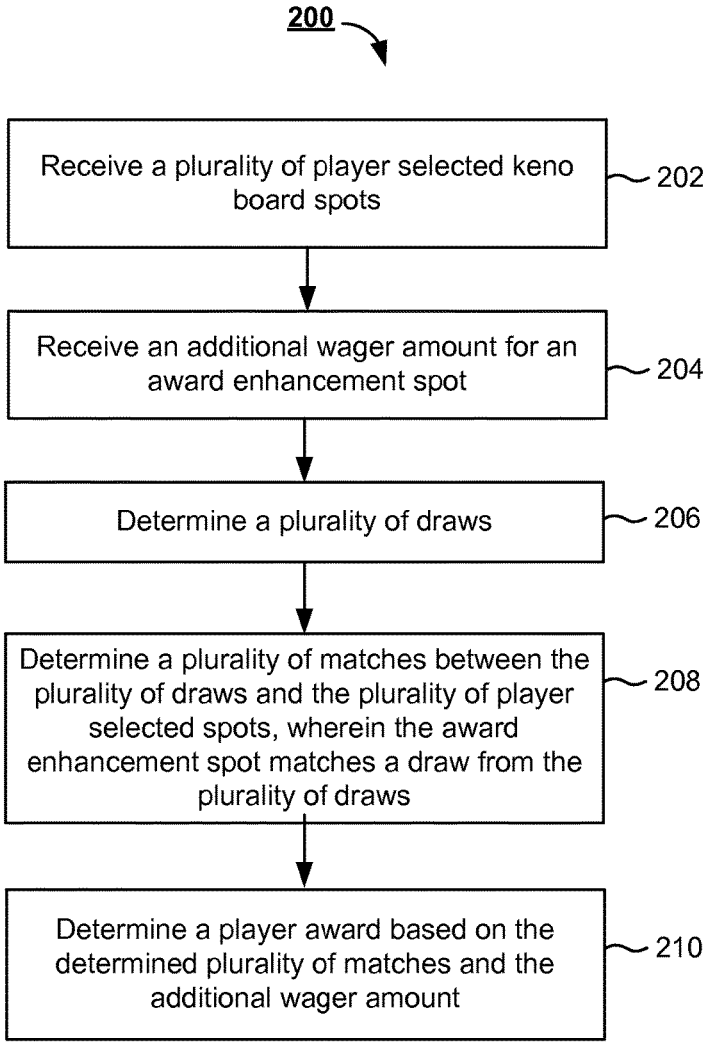
FIG. 2 is a flow diagram of a process for providing a keno game allowing for additional betting on a selected keno board spot, in accordance with an example implementation.

FIG. 2 is a flow diagram of a process 200 for providing a keno game allowing for additional betting, in accordance with an illustrative embodiment. The process 200 can be implemented on a computing device (e.g., a gaming machine, a user device, etc.). In one embodiment, the process 200 is encoded on a computer-readable medium that contains instructions that, when executed by the computing device, cause the computing device to perform operations of the process 200.

At block 202, a plurality of keno player selected spots is received. Using keno game user interface and/or input devices, the player may select spots on the keno board. For example, the player may select spots by tapping on keno board spots shown on the screen of the gaming machine or a computing device. The plurality of player selected spots may be any number of keno board spots. For example, as shown in FIG. 1B, the player may select six spots on the keno board.

An additional wager amount is received (block 204) for an award enhancement spot (e.g., "lucky spot"). In some embodiments, the award enhancement board spot is one of the spots in the plurality of player selected spots. In these embodiments, the player selects the award enhancement spot from the plurality of player selected spots and places the additional wager on the award enhancement spot. For example, the player select a keno board spot from the plurality of player selected spots by tapping on that keno board spot on the keno board, which in turn enables the player to enter the additional wager amount on this keno board spot.

In other embodiments, the award enhancement spot is a spot that is not included in the plurality of player selected spots. In these embodiments, the player first selects the plurality of player selected spots, and then selects an additional keno board spot (i.e., the award enhancement spot) for placing the additional wager on.

The player may type in the additional wager amount using the keno game user interface or select the additional wager amount from a provided listing of allowed additional wagers. For example, a series of buttons having allowed additional wager amounts may be shown, and the player may select one of the buttons to place the additional wager.

In other embodiments, the player may select a keno board spot twice in a row, and the second selection of the keno board spot indicates that the player wishes to place additional wager on this keno board spot. For example, the player may be allowed to select six keno board spots and also place additional wager on one of those spots. In this example, the player may first select a spot numbered 25. Then, the player may select a second spot numbered 47. Next, the player may select (e.g., by tapping on the spot, by touching spot, typing in the spot number, etc.) the spot numbered 47 again, thereby indicating that they wish to place an additional wager on the spot numbered 47. At this point, the player may place the additional wager on the spot numbered 47, or place the additional wager after finishing selecting the remaining four spots.

The player may be allowed to select more than one "lucky" spot. The keno game may provide user interface elements that allow the player selections of more than one "lucky" spot during a single keno game session. For example, the player may be allowed to select six spots, and two additional spots for placing additional wager on. In another example, the player may be allowed to select six spots, and then place additional wager on one of those spots, and also place second additional wager on another spot that is not included in the six player selected spots. In this example, the second additional wager may be larger than the first additional wager. Thus, the player may be allowed to place multiple additional wagers during a single keno game session.

A plurality of draws is determined (block 206). The keno game may determine the plurality of draws by selecting numbers from a set of available numbers. The plurality of draws may include any number of draws. For example, the plurality of draws may be twenty draws. In this example, twenty draws may be selected from the available set of numbers (e.g., from eighty numbers). The draws may be selected from the set of available numbers without replacement (i.e., once a number is selected from the set of available numbers, it is removed from the set of available numbers and will not be selected again during the same keno game session).

A plurality of matches between the plurality of draws and the plurality of player spots is determined (block 208), where the award enhancement spot matches a draw from the plurality of draws. The matches may be determined by comparing the player selected keno board spots to the draws. For example, if the keno board spot numbered 25 is a player selected keno board spot, and the keno board spot numbered 25 was also selected as a draw, then there is a match between the keno board spot numbered 25 and the draw keno board spot numbered 25. The award enhancement spot on which the player placed additional wager may match one of the draws.

Payout is determined (block 210) based on the determined plurality of matches and the additional wager amount. The total number of matches between the player selected keno board spots and draws may entitle the player to an award. In one implementation, a paytable may provide a mapping between various numbers of matches and corresponding awards. For example, two matches may entitle the player to an award of twenty points. When the award enhancement spot matches one of the draws, a bonus, additional award, free games, or any combination thereof may be awarded to the player.

For example, if the player wagers three points on the award enhancement spot, and the award enhancement spot matches a draw, then the total award that the player may receive is multiplied by three points, thereby tripling the player payout. In another example, the additional wager may serve as a trigger for awarding free games to the player. In this example, if the player places a wager of three points on the award enhancement spot and the award enhancement spot is hit by a draw, then the player is awarded three free games.

Figure 3:
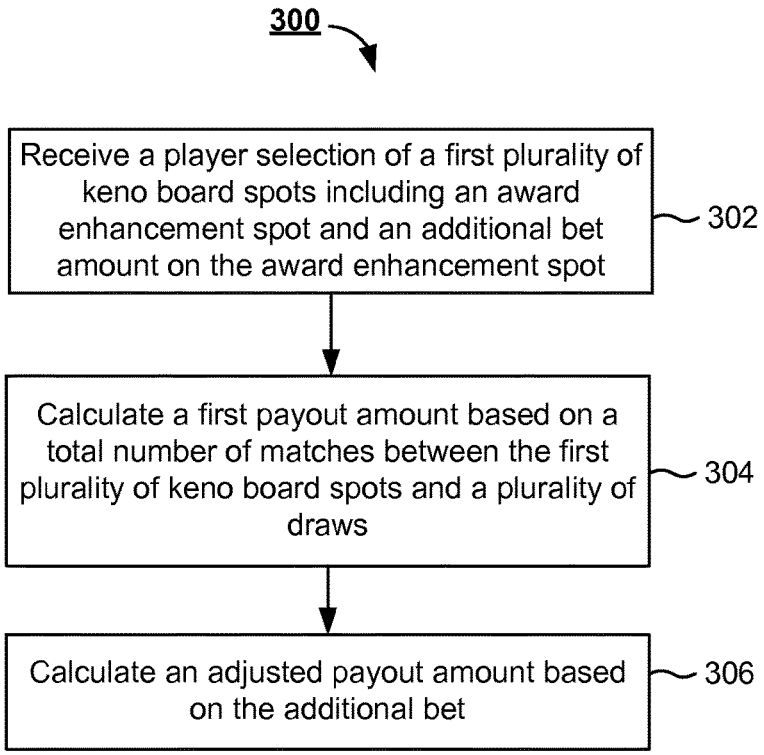
FIG. 3 is a flow diagram of a process for calculating an adjusted player payout in a keno game based in part on an additional player bet, in accordance with an example implementation.

FIG. 3 is a flowchart of a process for calculating an adjusted player payout based in part on an additional player bet, in accordance with an illustrative embodiment. The process 300 can be implemented on a computing device (e.g., a gaming machine, a user hand-held device, etc.). In one embodiment, the process 300 is encoded on a computer-readable medium that contains instructions that, when executed by the computing device, cause the computing device to perform operations of the process 300.

The process 300 includes receiving (block 302) a player selection of a first plurality of keno board spots including an award enhancement spot and an additional bet amount on the award enhancement spot. The player may select a first plurality of keno board spots using a keno board user interface (e.g., displayed on a screen of a gaming machine or a user device). The player may also select the award enhancement spot and make the additional bet on that spot. The player may select the award enhancement spot after selecting the plurality of keno board spots, and then selecting one of the spots from the plurality of keno board spots and placing the additional bet amount on that spot. The player selection may include the identification of the selected spots (e.g., numbers associated with the keno board spots).

A first payout amount is calculated (block 304) based on a total number of matches between the plurality of keno board spots and a plurality of draws. The award enhancement spot may match a first draw from a plurality of draws. The plurality of draws may be selected as discussed with respect to block 206 in FIG. 2. The selection of draws may be performed after the player selects keno board spots.

In some implementations, a paytable may be utilized to determine the first payout amount. In these implementations, the paytable may indicate a number of credits that the player is entitled to for a particular number of matches. For example, the paytable may indicate that the player is entitled to twenty credits for two matches, thirty credits for three matches, etc.

An adjusted payout amount is calculated (block 306) by multiplying the additional bet amount by the first payout amount. In some embodiments, the adjust payout is calculated because the award enhancement spot matches a first draw from a plurality of draws. Thus, the award enhancement spot matching one of the draws triggers awarding an additional award. In particular, the additional bet amount acts as a multiplier. In another embodiment, the additional bet amount may be used to award the player free games.

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

In various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, a gaming system may include a plurality of EGMs that are each configured to communicate with a central server, central controller, or a remote host through a data network.

In certain embodiments in which the gaming system includes an EGM in combination with a central server, central controller, or remote host, the central server, central controller, or remote host is any suitable computing device (such as a server) that includes at least one processor and at least one memory device or storage device. The EGM may include at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs).

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (e.g., main cabinet 404 shown in FIG. 4). In other embodiments, at least one of the at least one processor of the EGM and the at least one memory device of the EGM reside outside the cabinet of the EGM.

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD-ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. It should be appreciated that, in some embodiments, the EGM begins game play automatically upon appropriate funding rather than upon utilization of the game play activation device.

In certain embodiments, one or more input devices of the EGM are one or more wagering or betting devices. One such wagering or betting device is a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display decreases by one, and a number of credits shown in a bet display increases by one.

In other embodiments, one input device of the EGM is a cash out device. The cash out device is utilized to receive a cash payment or any other suitable form of payment corresponding to a quantity of remaining credits of a credit display.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are inputted to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, one input device of the EGM is a card reader in communication with the at least one processor of the EGM. The card reader is configured to read a player identification card inserted into the card reader.

Figure 4:
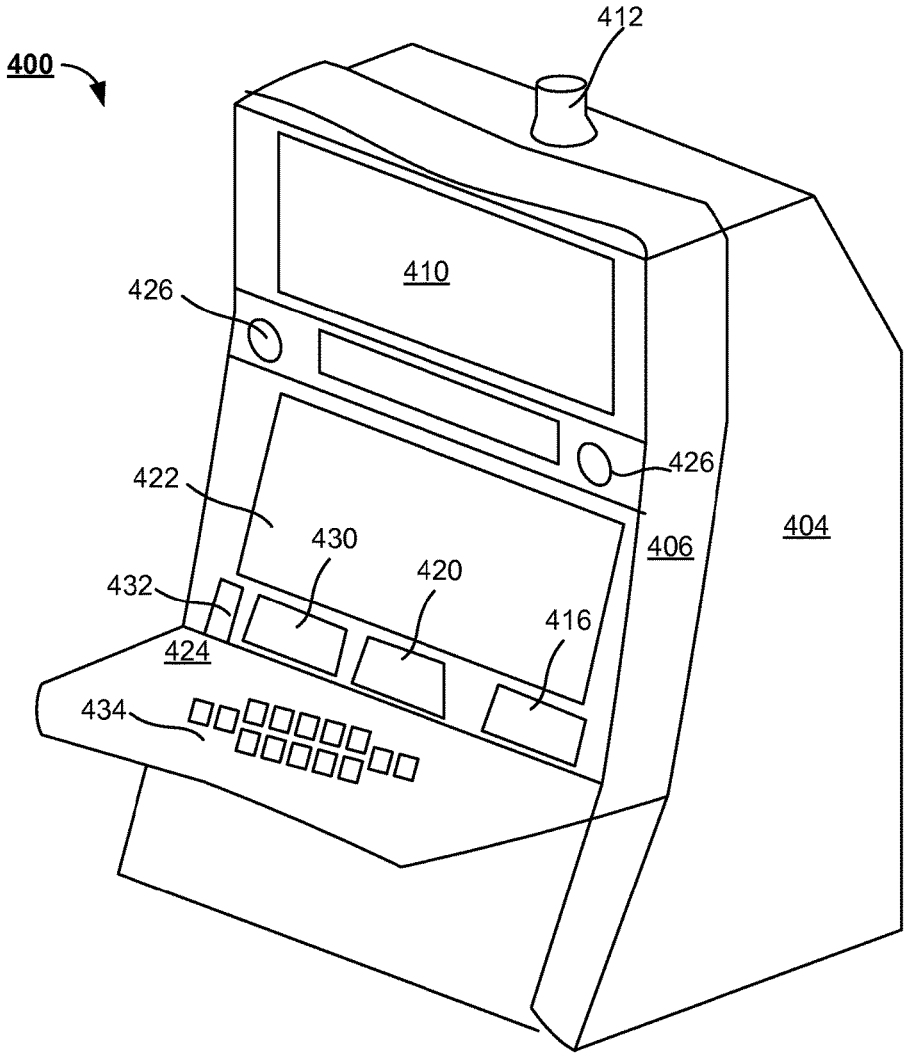
FIG. 4 is a diagram of an electronic gaming machine that can be used to play the keno game, in accordance with an example implementation.

In various embodiments, the EGM includes one or more output devices (e.g., display 410 shown in FIG. 4). One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status; (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. In another such embodiment, the EGM provides dynamic sounds coupled with attractive multimedia images displayed on one or more of the display devices to provide an audiovisual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games, such as the keno game of the present disclosure (in certain embodiments), and one or more secondary games, such as the keno game of the present disclosure (in other embodiments). In various embodiments, the primary game(s) and the secondary game (s) may comprise any suitable games and/or wagering games, such as, but not limited to: electro-mechanical or video slot or spinning reel type games; video card games such as video cribbage, video draw poker, multi-hand video draw poker, other video poker games, video blackjack games, and video baccarat games; video keno games; video bingo games; and video selection games.

In certain embodiments in which the secondary game (such as when the keno game of the present disclosure is the primary game) or the primary game (such as when the keno game of the present disclosure is the secondary game) is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In certain such embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout to be obtained in addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, if qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's player tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

Referring to FIG. 4, an example EGM for running or executing the keno game of the present disclosure is shown as electronic gaming device 400, in accordance with described embodiments. The gaming device 400 may include a main cabinet 404. The main cabinet 404 may provide a secure enclosure that prevents tampering with device components, such as a game controller (not shown) located within the interior of the main cabinet 404. The main cabinet 404 may include an access mechanism, such as a door 406, which allows the interior of the gaming device 400 to be accessed. Actuation of a door 406 may be controlled by a locking mechanism 414. In some embodiments, the locking mechanism 414, the door 406, and the interior of the main cabinet 404 may be monitored with security sensors of various types to detect whether the interior has been accessed. For instance, a light sensor may be provided within the main cabinet 404 to detect a change in light-levels when the door 406 is opened and/or an accelerometer may be attached to the door 406 to detect when the door 406 is opened.

The gaming device 400 may include any number of user interface devices that convey sensory information to a user and/or receive input from the user. For example, the gaming device 400 may include electronic displays 410, 422, speakers 426, and/or a candle device 412 to convey information to the user of the gaming device 402. The gaming device 402 may also include a console 424 having one or more inputs 434 (e.g., bonus buttons, track pads, etc.) configured to receive input from a user. For instance, the player may place a wager, select the starter card, and/or select the discards from the plurality of player cards by manipulating the one or more inputs 434. In one embodiment, the display 410 and/or the display 422 may also be a touch screen display configured to receive input from a user. A controller (not shown) within the gaming device 402 may run a game, such as a wager-based game based on the process 200, 300 or another process described above, in response to receiving input from a user via the inputs 434, the display 422, or the display 410. For example, the inputs 434 may be operated to place a wager in the keno game and to run the keno game.

The gaming device 400 may also include devices for conducting a wager-based game (e.g., a video keno game). For example, the gaming device 400 may include a ticket acceptor 416 and a printer 420. In various embodiments, the gaming device 400 may be configured to run on credits that may be redeemed for money and/or other forms of prizes. The ticket acceptor 416 may read an inserted ticket having one or more credits usable to play a game on the gaming device 400. For example, a player of the gaming device 400 may wager one or more credits within a video keno game. If the player loses, the wagered amount may be deducted from the player's remaining balance on the gaming device 400. However, if the player receives a payout, the player's balance may be increased by the amount of the payout. Any remaining credit balance on the gaming device 400 may be converted into a ticket via the printer 520. For example, a player of the gaming device 400 may cash out of the machine by selecting to print a ticket via the printer 420. The ticket may then be used to play other gaming machines or redeemed for cash and/or prizes. According to various embodiments, the gaming device 402 may record data regarding its receipt and/or disbursement of credits. For example, the gaming device 400 may generate accounting data whenever a result of a wager-based game is determined. In some embodiments, the gaming device 400 may provide accounting data to a remote data collection device, allowing the remote monitoring of the gaming device 400.

In one embodiment, the gaming device 400 may include a loyalty card acceptor 430. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming device 400. For example, a user having a loyalty account may be given a bonus turn on the gaming device 400 or credited loyalty points for playing the gaming device 400. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal (e.g., a machine-generated electrical, optical, or electromagnetic signal) that is generated to encode information for transmission to a suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The terms "client" or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback;

and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, the method comprising:

causing, by a processor, a display device to display a keno board comprising a set of multiple spots;

receiving, via an input device, at least one player spot input representing a plurality of player-selected spots of the set of multiple spots and an award enhancement spot input representing a player-selected award enhancement spot from the set of multiple spots, wherein the award enhancement spot input comprises one of a plurality of different player-selected wager amounts associated with said player-selected award enhancement spot, said plurality of different player-selected wager amounts comprising a first wager amount associated with a first quantity of hits and a second greater wager amount associated with a second greater quantity of hits;

randomly determining, by the processor, a plurality of drawn spots of the set of multiple spots;

determining, by the processor, a quantity of hits by determining whether any of the plurality of drawn spots match any of the plurality of player-selected spots and the player-selected award enhancement spot, wherein a match between the player-selected award enhancement spot and one of the plurality of drawn spots increases the quantity of hits by an amount associated with the one of the plurality of different player-selected wager amounts; and determining, by the processor, a player award based on the quantity of hits.

2. The method of claim 1, wherein the plurality of player-selected spots comprise the player-selected award enhancement spot.

3. The method of claim 1, wherein determining, by the processor, the player award comprises:

determining, by the processor, a first award amount responsive to determining a first quantity of hits; and determining, by the processor, a second award amount responsive to determining a second quantity of hits, wherein the first and second award amounts are different and the first and second quantities of hits are different.

4. The method of claim 3, wherein the player award is in part based on the number of player-selected spots.

5. The method of claim 1, further comprising receiving, via the input device, the award enhancement spot input after receiving, via the input device, the at least one player spot input.

6. The method of claim 1, further comprising receiving, via the input device, the award enhancement spot input before receiving, via the input device, the at least one player spot input.

7. The method of claim 1, further comprising:

receiving, by an acceptor, a physical item associated with a monetary value;

establishing, by the processor, a credit balance based on the monetary value responsive to receiving the physical item, wherein the credit balance is decreasable by the player-selected wager amount and increasable by any player award;

receiving, by the input device, a cashout input; and initiating, by the processor, a payout associated with the credit balance responsive to the cashout input, wherein determining, by the processor, the player award comprises determining, by the processor, the player award based in part on the player-selected wager amount.

8. The method of claim 1, wherein the display device and the input device are parts of a mobile device.

9. The method of claim 8, wherein the processor is not part of the mobile device.

10. A gaming system comprising:

a display device;

a user-input panel; and a game controller having one or more data processors and one or more storage devices storing instructions that, when executed by the one or more data processors, cause the one or more data processors to:

cause the display device to display a keno board comprising a set of multiple spots;

receive, via the user-input panel, at least one player spot input representing a plurality of player-selected spots of the set of multiple spots and an award enhancement spot input representing a player-selected award enhancement spot from the set of multiple spots, wherein the award enhancement spot input comprises one of a plurality of different player-selected wager amounts associated with said player-selected award enhancement spot, said plurality of different player-selected wager amounts comprising a first wager amount associated with a first quantity of hits and a second greater wager amount associated with a second greater quantity of hits;

randomly determine a plurality of drawn spots of the set of multiple spots;

determine a quantity of hits by determining whether any of the plurality of drawn spots match any of the plurality of player-selected spots and the player-selected award enhancement spot, wherein a match between the player-selected award enhancement spot and one of the plurality of drawn spots increases the quantity of hits by an amount associated with the one of the plurality of different player-selected wager amounts; and determine a player award based on the quantity of hits.

11. The gaming system of claim 10, wherein the plurality of player-selected spots comprises the player-selected award enhancement spot.

12. The gaming system of claim 10, wherein the instructions, when executed by the one or more data processors, cause the one or more data processors to determine the player award by:

determining a first award amount responsive to determining a first quantity of hits; and determining a second award amount responsive to determining a second quantity of hits, wherein the first and second award amounts are different and the first and second quantities of hits are different.

13. The gaming system of claim 12, wherein the player award is in part based on the number of spots in the plurality of player-selected spots.

14. The gaming system of claim 10, wherein the instructions, when executed by the one or more data processors, cause the one or more data processors to enable input of the award enhancement spot input after receiving the at least one player spot input.

15. The gaming system of claim 10, further comprising an acceptor configured to receive a physical item associated with a monetary value, and wherein the instructions, when executed by the one or more data processors, cause the one or more data processors to:

establish a credit balance based on the monetary value responsive to receipt, by the acceptor, of the physical item, wherein the credit balance is decreasable by the player-selected wager amount and increasable by any player award; and initiate a payout associated with the credit balance responsive to receipt, by the user-input panel, of a cashout input, wherein any player award based in part on the player-selected wager amount.

16. The gaming system of claim 10, wherein the display device and the user-input panel are parts of a mobile device.

17. The gaming system of claim 16, wherein the processor is not part of the mobile device.

* * * * *